United States Patent [19]

Marsh

[11] 4,355,225

[45] Oct. 19, 1982

[54] INSTANT-ON RADIANT FUSER

[75] Inventor: Dana G. Marsh, Fairport, N.Y.

[73] Assignee: Xerox Corporation, Stamford, Conn.

[21] Appl. No.: 248,136

[22] Filed: Mar. 30, 1981

[51] Int. Cl.[3] ..... H05B 1/00

[52] U.S. Cl. ..... 219/216; 219/354; 219/347; 355/3 FU; 432/227

[58] Field of Search ..... 219/216, 345, 347, 354, 219/388, 469, 544; 29/132; 250/317; 428/447; 432/59, 227; 355/3 FU, 3 R, 14; 427/22

[56] References Cited

U.S. PATENT DOCUMENTS

| | | | |
|---|---|---|---|
| 3,280,717 | 10/1966 | Bungay | 219/216 X |
| 3,766,644 | 10/1973 | Davis | 219/544 |
| 3,795,033 | 3/1974 | Donnelly et al. | 29/132 |
| 3,809,854 | 5/1974 | Sanders | 219/216 |
| 3,848,305 | 11/1974 | Jachimiak | 29/132 |
| 3,874,892 | 4/1975 | McInally | 219/216 X |
| 3,898,424 | 8/1975 | Thettu | 219/216 |
| 3,945,726 | 3/1976 | Ito et al. | 355/3 R |
| 3,953,709 | 4/1976 | Elter | 219/216 |
| 4,059,394 | 11/1977 | Ariyama et al. | 219/216 |
| 4,064,313 | 12/1977 | Takiguichi et al. | 428/447 |
| 4,078,286 | 3/1978 | Takiguichi et al. | 29/132 |
| 4,121,888 | 10/1978 | Tomura et al. | 355/14 |

*Primary Examiner*—Volodymyr Y. Mayewsky

[57] ABSTRACT

An instant-on radiant fuser apparatus for fusing toner images in an electrostatographic copying machine, which does not require the use of any standby heating devices and yet is capable of fusing the first copy in a matter of seconds. The radiant fuser apparatus is made of a low mass reflector thermally spaced from a housing, with the housing and the reflector together forming a conduit for the passage of cooling air therein. A low mass platen is provided which is constructed to achieve operating temperature conditions in a matter of a few seconds without the use of any standby heating device. A housing for the platen is also provided to form a conduit for the passage of cooling air to control the temperature of the platen.

14 Claims, 4 Drawing Figures

INSTANT-ON RADIANT FUSER

This invention relates to a novel radiant fuser apparatus, and more particularly to an instant-on radiant fuser apparatus which requires no standby power or heating device.

BACKGROUND OF THE INVENTION AND PRIOR ART STATEMENT

As indicated in U.S. Pat. No. 4,078,286, in a typical process for electrophotographic duplication, a light image of an original document to be copied is recorded in the form of a latent electrostatic image upon a photosensitive member, and the latent image is subsequently rendered visible by the application of electroscopic particles, which are commonly referred to as toner. The physical toner image is then in a loose powdered form and it can be easily disturbed or destroyed. The toner image is usually fixed or fused upon a support, which may be the photosensitive member itself or another support such as a sheet of plain paper. The present invention relates to the fusing of the toner image upon a support.

It should be understood that for the purposes of the present invention, which relates to the fusing of the toner image upon a support, the latent electrostatic image may be formed by means other than by the exposure of an electrostatically charged photosensitive member to a light image of an original document. For example, the latent electrostatic image may be generated from information electronically stored or generated, and the digital information may be converted to alphanumeric images by image generation electronics and optics. However, such image generation electronic devices and optic devices form no part of the present invention.

In order to fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

The use of thermal energy for fixing toner images onto a support member is well known. Several approaches to thermal fusing of electroscopic toner images have been described in the prior art. These methods include providing the application of heat and pressure substantially concurrently by various means: a roll pair maintained in pressure contact; a flat or curved plate member in pressure contact with a roll; a belt member in pressure contact with a roll; and the like. Heat may be applied by heating one or both of the rolls, plate members or belt members. The fusing of the toner particles takes place when the proper combination of heat, pressure and contact time are provided. In these contact fusing processes, it is important to insure that substantially no offset of the toner particles from the support to the fuser member takes place. It is known in the prior art to prevent offset by imparting release properties to the fuser member, or the pressure member by covering such members with a surface layer of a release material such as polytetrafluoroethylene, silicone rubber, or the like. A suitable offset preventing liquid may be used on the fuser member to minimize or avoid offsetting. Silicone oils are widely used as the offset preventing or release agent. Representative prior art disclosing such contact fusing include U.S. Pat. Nos. 4,078,286; 4,064,313; 3,809,854; 3,848,305; and 3,795,033. While such prior art contact fusing systems have been effective in providing the fusing of many copies in relatively large and fast copying and duplicating machines, in which the use of standby heating elements to maintain the machine at or near its operating temperature can be justified, there is a continuing need for an instant-on fuser which requires no standby power for maintaining the fuser apparatus at a temperature above the ambient. In addition, the prior art contact fusing systems are generally relatively expensive to construct, and thus they are primarily suited for use in relatively large and fast copying and duplicating machines.

It is also known in the art to fuse toner images by the use of a flash fusing process. An example of such a process is disclosed in U.S. Pat. No. 3,874,892. In such a flash fusing process, a flash lamp or other source of radiant energy is generally pulsed on for a very short period of time. The absorption of the radiant energy by the toner particles results in the fusing of the toner to the substrate. It can be appreciated that since the lamp is pulsed or flashed on for a short period of time, a large amount of power must be used to accomplish the fusing of the toner particles. Thus, one drawback of a flash fusing process is the relatively large and expensive power supply required. Another problem with flash fusing is image explosion whereby toner is evaporated with each flash and deposited on the wall of the fusing cavity. This necessitates the cleaning or replacing of the reflective lining in the flash fusing chamber.

Another method for fusing toner images to a substrate is radiant fusing. Radiant fusing differs from flash fusing, inter alia, in that in radiant fusing the radiant energy source, typically an infrared quartz lamp, is turned on during the entire fusing step, rather than pulsed on for a short period of time as in flash fusing. Examples of radiant fuser apparatus are shown in U.S. Pat. Nos. 3,898,424 and 3,953,709. Such prior art radiant fusers are generally made of relatively heavy metallic construction which requires the constant use of a heating element to maintain the apparatus at standby temperature.

In summary, while the prior art fusers have been effective in providing the fusing of copies in relatively large and fast copying and duplicating machines, in which the use of standby heating elements to maintain the machine at or near its operating temperature can be justified, there is a continuing need for an instant-on fuser which requires no standby power for maintaining the fuser apparatus at a temperature above the ambient.

Accordingly, it is an object of the invention to provide an improved fusing apparatus which can be instantly turned on and yet requires no standby power or heating element.

It is a further object of the present invention to provide an inexpensive fusing apparatus which is economical to operate.

These and other objects of the invention can be gathered from the following detailed disclosure.

SUMMARY OF THE INVENTION

The above objects are accomplished in accordance with the present invention by an instant-on radiant fuser apparatus which is made of a reflector housing, a low mass reflector thermally spaced from the housing, with the housing and the reflector together forming a conduit for the passage of a cooling medium therein such as air, a low mass platen spaced from the reflector and a platen housing, with the platen and its housing together forming another conduit for the passage of a cooling medium therein, and a source of radiant energy positioned adjacent the reflector and between the reflector and the platen, so that a toner image bearing sheet may be passed between the platen and the source of radiant energy to thereby fuse the toner image onto the substrate. The low mass reflector and the low mass platen are both constructed so that they will achieve operating temperatures from an ambient start during the time period from the initiation of the copying cycle to the time when the toner image bearing substrate reaches the fuser apparatus.

DETAILED DESCRIPTION OF THE INVENTION

Although, as indicated above, the present instant-on radiant fuser apparatus is most useful in an electrostatographic copying machine, particularly in an inexpensive and small copying machine, it will be appreciated by one skilled in the art that the apparatus of the present invention may be used in other applications where substantially instant-on capability for heating an image-bearing substrate is advantageous.

Figure 1:
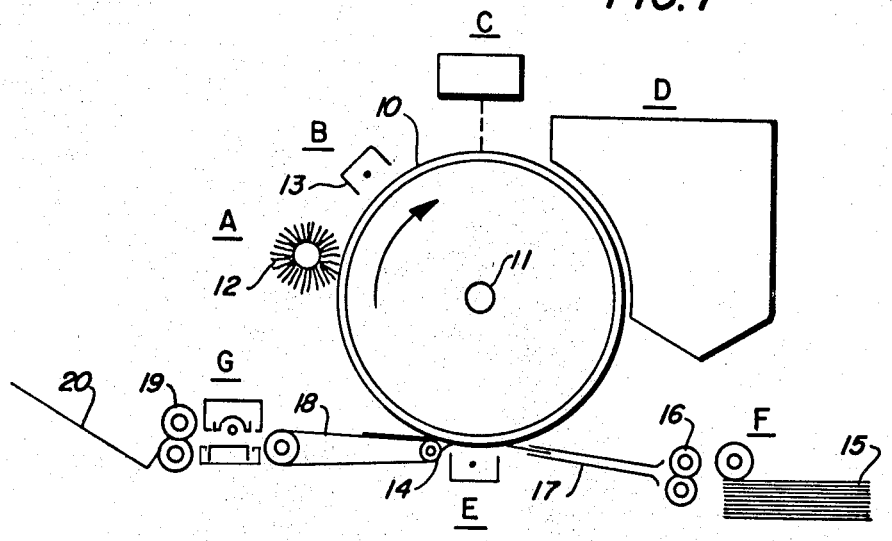
FIG. 1 is a schematic illustration of a copying machine in which the instant-on radiant fuser apparatus of the present invention may be used.

Referring to FIG. 1, an electrostatographic copying machine is schematically illustrated. In this machine, an imaging surface is provided by a drum-like member 10, which is coated with a photoconductive insulating material. In operation, drum 10 is rotated about a shaft 11 in a clockwise direction as indicated by the arrow. The various processing steps in the electrostatographic copying operation are then carried out at stations located around the periphery of drum 10. Thus, at station A a brush-like member 12 is rotated and in contact with the surface of drum 10 to clean the surface in preparation for copying thereon. At station B, the surface of the drum is uniformly charged with an electrostatic charge, for example, by a corona discharge device 13. After charging, the rotation of the drum brings the charged portion of the drum surface to station C, where it is exposed to a light image of the original document to be copied. The electrostatic latent image formed at station C advances to station D, where the latent image is developed or rendered visible by the application of toner particles. The developed image on the surface of the drum 10 then advances to station E, where the image is transferred to a sheet of paper or other substrate 14. Thereafter, the surface of the drum 10 advances to station A, where it is cleansed of residual toner particles for repeating the copying cycle. A supply of paper 15 is available at the feed station F and individually fed through roller pairs 16 and paper guides 17 to station E. After the toner image is transferred to paper 14, it is transported by transport means 18 to fusing station G, where the toner image is fused into the paper substrate. After the fusing process, the paper 14 is advanced through roller pairs 19 to a catch tray 20. The foregoing description describes generally the operations of one embodiment of the known electrostatographic copying process. It is known to those skilled in the art. The present invention is concerned with the fusing apparatus employed at station G.

Figure 2:
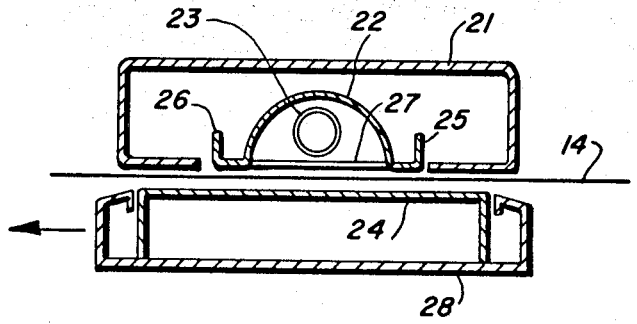
FIG. 2 represents a cross-sectional view of the instant-on radiant fuser apparatus of the present invention.

A preferred embodiment of the instant-on radiant fuser apparatus of the present invention is illustrated in FIG. 2, in a cross-sectional view. In FIG. 2, the paper 14 bearing the toner on its upper surface is seen passing through the fuser apparatus. The portion of the fuser apparatus above paper 14 is made of a housing 21, a reflector means 22, and a source of radiant energy 23. The portion of the fuser apparatus below paper 14 is made of a platen 24 and platen housing 28. Housings 21 and 28 are essentially in the shape of a channel. They may be made of any material but I prefer to make them with relatively thin gauge aluminum, for example, 0.032 inch thick aluminum. When aluminum or other thermally conductive material is used in making housings 21 and 28, the housings should be thermally spaced from the reflector means 22 and platen 24, respectively. In FIG. 2, the two end legs of the channel comprising housing 21 are shown to terminate before they reach reflector means 22. In this manner, housing 21 and reflector means 22 are thermally spaced by a thin layer of air. Alternatively, reflector means 22 may be thermally spaced from housing 21 by means of a thin coating of asbestos or other thermally insulating material on end surfaces 25 and 26. Similarly, the ends of housing 28 also may be insulated from platen 24 to enable the platen to be rapidly warmed up from ambient temperature. The thermal spacing between reflector means 22 and the housing 21, and between platen 24 and housing 28 is one element of the present invention enabling the instant radiant fuser apparatus to require no standby power and yet be substantially instantly available for fusing. This will be further described below.

The reflector means 22 must be made of a very low mass reflector material. An example of a suitable material for reflector means 22 is a 0.008–0.012 inch thick (8–12 mils) specular aluminum. Another satisfactory material is 0.002–0.004 inch thick specular stainless steel.

The low mass nature of the reflector means is an important aspect of the present invention. To achieve the instant-on capability of the radiant fuser of this invention, yet without the use of a pulse of high power as in a flash fuser and without the use of standby power, the major components of the radiant fuser must attain their operating temperatures, from an ambient start, in the few seconds between the time an operator activates the "Start" button and the point when the toner image arrives at the fusing station. In a desk-top copier, this period may be, for example 3–5 seconds. Since in a radiant fuser the reflector typically provides between one fourth to one half of the total heating energy needed for fusing, it is important that the reflector substantially achieves its operating temperature in about 4 seconds or so. Surprisingly, I have found that a very low mass reflector, as disclosed herein, and thermally spaced from the relatively higher mass lower temperature housing, can be heated from an ambient temperature of say 65° F. to an operating temperature in excess of 400° F. in about 4 seconds, with the use of only the normal heating lamp for the radiant fuser—that is, without the use of auxiliary heating means.

The source of radiant energy 23 may be an infrared heater such as a quartz lamp. I have found that a lamp having a power between 400 to 800 watts would give adequate fusing in the instant-on radiant fuser apparatus of the present invention, depending on the speed of advancement of the paper 14 through the fuser apparatus. A shield for the quartz lamp, such as a quartz shield 27, may be provided to shield the lamp and the reflector means from the paper, debris and other machine impurities. Such a quartz shield is substantially transparent to the infrared radiation and it is known to those skilled in this art. For example, I prefer to use a quartz shield 0.050 inch in thickness.

The platen 24 is intended to support and guide the paper 14 through the fuser apparatus. Unlike certain prior fuser devices, the present instant-on radiant fuser apparatus does not depend on platen 24 to provide a portion of the thermal energy to paper 14 in order to fuse the toner image thereon. Thus, platen 24 should be so constructed that it can be warmed by lamp 23 in the 3–5 seconds that are available between the time when an operator pushes the Start button on the copying machine and the time when paper or substrate 14 enters the fuser apparatus. During that period of time, platen 24 should be warmed or heated by lamp 23 to a temperature somewhat above the temperature of paper 14 in the fuser apparatus. With a quartz lamp 23 of about 450 watts power, I have found that platen 24, as described hereinafter, will reach a temperature of about 300° F., and the reflector means 22 will be above 400° F. These temperatures are all subject to a fairly wide range, for example, ±30° F. or more.

I prefer to make platen 24 out of thin gauge aluminum, for example 0.008–0.012 inch thick aluminum. The side of the platen 24 facing the quartz lamp 23 should be covered with an energy absorbing material, such as a dark colored high temperature paint, to maximize the absorption of thermal energy. I have found that a pigmented, highly crosslinked polysiloxane marketed by the Dow Corning Company under its trademark Vestar is very suitable for this purpose. Another example of useful platen is one made of dyed or anodized aluminum.

Since the first sheet of paper 14 will reach the fuser apparatus in about 4 seconds after an operator has activated the Start button on the copying machine, the instant-on radiant fuser apparatus of the present invention must attain its operating temperatures during those few seconds. By means of an extremely low mass reflector means 22, the heat absorbing low mass platen 24, the thermal spacing between the reflector means 22 and the housing 21, and the thermal spacing between the low mass platen 24 and the platen housing 28, the instant-on radiant fuser apparatus of the present invention is able to achieve the operating temperatures in those few seconds. It is very important for the reflector means 22 and platen 24 to attain their operating temperatures by the time the first copy arrives at the fuser apparatus. Thereafter, when the toner image on paper 14 is being fused, the temperature of the reflector means 22 must be controlled so that the quartz lamp 23 will not damage the reflector means 22. This is accomplished by circulating cooling air in the conduit formed by the housing 21 and reflector means 22. Similarly, cooling air is provided to platen 24 through the conduit formed by platen 24 and housing 28, to control the temperature of the platen within acceptable limits. For maximum effectiveness, the cooling air should be of a volume to create turbulent flow conditions in the conduits.

Figure 3:
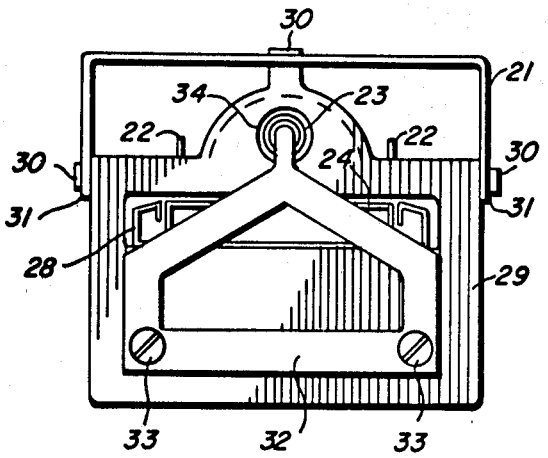
FIG. 3 illustrates one face of an end block member for mounting the components of the instant-on radiant fuser apparatus thereon.
Figure 4:
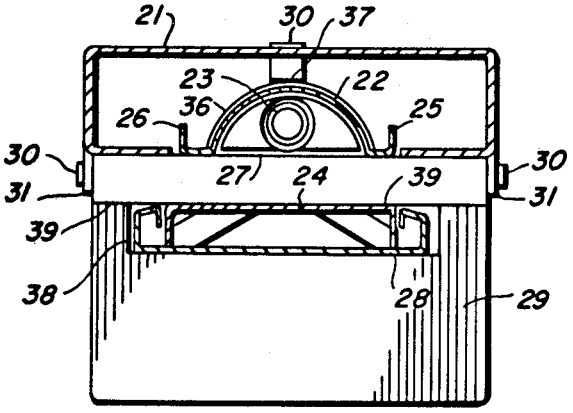
FIG. 4 illustrates the end block member of FIG. 3, on its reverse side.

FIGS. 3 and 4 illustrate one method for mounting the components of the instant-on radiant fuser apparatus of the present invention. These components may be mounted between a pair of end blocks, one of which is shown in FIG. 3. In FIG. 3, the end block means 29 is shown to have three lugs 30 which are seated in slots on housing 21. This embodiment of housing 21 has two downwardly extending portions 31 to accommodate two of the lugs 30. A spring plate 32, fastened to end block means 29 by fastening means 33, serves the dual function of retaining the quartz lamp 23 in the opening 34 as well as to provide electrical connection to the quartz lamp 23. Spring plate 32 is connected to a source of power (not shown). It will be appreciated that spring plate 32 may be bent slightly to permit the removal or replacement of quartz lamp 23 without having to take apart the fuser assembly.

In FIG. 4, the other side of the end block means 29 is illustrated. An opening 34 in end block means 29 is provided for the passage of the quartz lamps 23. Groove 36 in the end block means 29 is provided for the seating of the reflector means 22 and quartz shield 27 therein. A reference surface 37 in the end block 29, below the center lug 30, is provided to cooperate with groove 36 for the seating of reflector 22. The platen 24 and platen housing 28 are detachably mounted on holding means (not shown) in the copying machine, not directly connected to upper fuser assembly mounted on the end block means 29. In this manner, when the upper fuser assembly is removed from the copying machine, the platen and its housing are exposed for easy servicing or replacement. The modular nature of the upper fuser assembly, comprising the end block means and components attached or seated therein, and of the platen assembly contributes to the very low manufacturing and maintenance costs of the instant-on radiant fuser of the present invention. An opening 38 is provided in end block means 29 to permit communication between the conduit formed by the platen 24 and platen housing 29 and the source of cooling air. A datum surface 39 is provided on the end block means to insure the proper alignment of the platen assembly with respect to the upper fuser assembly. The end block means 29 may be made of any heat resistant material, such as ceramic material. I have found that a high temperature resistant polyphenylene sulfide resin marketed by the Phillips Petroleum Company under its trademark Ryton is suitable for this purpose.

It will be appreciated that, with the preferred embodiment of the invention described above, the present radiant fuser can be easily detached as a unit and further opened up by disconnecting housing 21 from end block 29 by plying the lugs 30 out of the slots in which they are seated. In this manner, the components of the radiant fuser may be easily serviced or replaced.

The invention will now be described with reference to the following specific example.

EXAMPLE

An instant-on radiant fuser assembly essentially as shown in FIGS. 2–4 was constructed with 12 mil specular aluminum for the reflector housing and the reflector. The platen or base plate was made with 8 mil black anodized aluminum. The platen housing was made with 12 mil specular aluminum. The fuser assembly was mounted in a Xerox 2600 (a trademark of Xerox Corporation) machine modified to accept the fuser assembly. A 650 watt quartz fuser lamp operated at 450 watt power was used as the radiant energy source. The lamp and the fan for circulating cooling air were turned on at the same time as when the copying cycle was initiated. The base plate reached a temperature of about 300° F. when the first copy entered the fuser assembly. Cooling air from the fan was circulated through the chamber formed by the housing and the reflector at a rate of about 7 cubic feet per minute (CFM), which resulted in turbulent flow conditions. Similarly, cooling air was circulated through the chamber formed by platen 24 and housing 28 at a rate of about 5 CFM. The reflector was thus maintained at about 400° F. while the base plate or platen was maintained at about 300° F., with both of these temperatures within a range of ±30° F. A 60 mil quartz shield was provided to shield the lamp from the paper and debris. It was found that during the passage of the copy paper through the fuser assembly, the base plate temperature dropped about 10° F. but, with a spacing of a little over 3 inches between copies going through the fuser assembly, the base plate recovered to its initial temperature. After 40 copies have been fused, the temperatures and other conditions were found to be essentially stable. It was found that with the machine at rest at room temperature when the Start button was activated, the instant-on radiant fuser disclosed herein is capable of furnishing the first fused copy in about 10 seconds.

It will be appreciated that the present radiant fuser is extremely economical to construct and to operate. Thus, no temperature sensing means, which are extensively used in prior art fusing devices, are required. In the specific embodiment disclosed above, the cooling air flow was initiated at about the same time as when the fuser lamp was turned on. There is also no need for a standby heating device to maintain the fuser at an elevated temperature. For safety, a fusible link may be provided which will shut down the entire machine when the temperature in the fuser assembly, through accident or other machine malfunction, becomes too high.

While the invention has been described in detail in reference to specific and preferred embodiments, it will be appreciated that various modifications may be made from the specific details without departing from the spirit and scope of the invention.

What is claimed is:

1. An instant-on radiant fuser apparatus, which comprises:

a first housing;

a low mass reflector means thermally spaced from said first housing, said reflector means being constructed to achieve operating temperature conditions within a few seconds without the use of standby heating device;

said first housing and said reflector means together forming a conduit for the passage of a cooling medium therein;

a second housing;

a low mass platen facing said reflector means and spaced therefrom, said platen being thermally spaced from said second housing and being constructed to achieve operating temperature conditions within a few seconds without the use of standby heating device;

said second housing and said platen together forming a conduit for the passage of a cooling medium therein; and a source of radiant energy positioned adjacent said reflector means and between said reflector means and said platen.

2. An instant-on radiant fuser apparatus according to claim 1 wherein said low mass reflector means is a thin gage metallic reflector.

3. An instant-on radiant fuser apparatus according to claim 2 wherein said low mass platen is made of a thin gage metallic material having on its surface an energy absorbing material.

4. An instant-on radiant fuser apparatus according to claim 2 wherein said low mass reflector means is made of specular aluminum about 8 to 15 mils thick.

5. An instant-on radiant fuser apparatus according to claim 3 wherein said low mass platen is made of aluminum about 8 to 15 mils thick and coated with a pigmented energy absorbing material.

6. An instant-on radiant fuser apparatus according to claim 5 wherein said pigmented energy absorbing material is a black pigmented polysiloxane.

7. An instant-on radiant fuser apparatus according to claim 1 further comprising means for supplying air to said conduits as the cooling medium at a rate to create turbulent flow in said conduits.

8. An instant-on radiant fuser apparatus, for fusing toner images to a substrate in an electrostatographic copying machine, which comrises:

a pair of end block means in facing relationship;

a first housing mounted on said end block means;

a low mass reflector means mounted on said end block means and thermally spaced from said first housing, said reflector means being constructed to achieve operating temperature conditions by the time the first copy reached said fuser apparatus without the use of standby heating device;

said first housing and said low mass reflector means together forming a conduit between said pair of end block means for the passage of a cooling medium therein;

a second housing;

a low mass platen facing said reflector means and spaced therefrom, said platen being thermally spaced from said second housing and being constructed to achieve operating temperature conditions by the time the first copy reached said fuser apparatus without the use of standby heating device;

said second housing and said platen together forming a conduit for the passage of a cooling medium therein; and a source of radiant energy mounted on said end block means and positioned adjacent said reflector means and between said reflector means and said platen, so that when said toner image bearing substrate is passed between the platen and the source of radiant energy the toner image is fused to the substrate.

9. An instant-on radiant fuser apparatus according to claim 8 wherein the end block means are made of a ceramic material or a high temperature resistant polymeric material.

10. An instant-on radiant fuser apparatus according to claim 9 wherein the end block means are made of a polyphenylene sulfide resin.

11. An instant-on radiant fuser apparatus according to claim 8 further comprising means for supplying air to said conduits as the cooling medium at a rate to create turbulent flow in said conduits.

12. An instant-on radiant fuser apparatus according to claim 8 wherein said first housing is mounted on said end block means by snap-on means which can be quickly disconnected to expose the components of said radiant fuser for servicing or replacement.

13. An instant-on radiant fuser apparatus according to claim 8 wherein said pair of end block means, said first housing, said low mass reflector means, and said source of radiant energy together forming an upper fuser assembly which is detachably mounted in said copying machine, and wherein said low mass platen and said second housing forming a lower fuser assembly, said lower fuser assembly is exposed by the removal of the upper fuser assembly.

14. An instant-on radiant fuser apparatus according to claim 13 wherein said end block means having a datum surface for aligning said lower fuser assembly with said upper fuser assembly.

* * * * *